US005132707A

United States Patent [19]

O'Neill

[11] Patent Number: 5,132,707

[45] Date of Patent: Jul. 21, 1992

[54] INK JET PRINTHEAD

[75] Inventor: James F. O'Neill, Penfield, N.Y.

[73] Assignee: Xerox Corporation, Stamford, Conn.

[21] Appl. No.: 632,893

[22] Filed: Dec. 24, 1990

[51] Int. Cl.[5] ..... A41J 2/05

[52] U.S. Cl. ..... 346/140 R; 346/1.1

[58] Field of Search ..... 346/140; 156/644

[56] References Cited

U.S. PATENT DOCUMENTS

| | | | |
|---|---|---|---|
| Re. 32,572 | 1/1988 | Hawkins et al. | 156/626 |
| 4,394,670 | 7/1983 | Sugitani | 346/140 |
| 4,567,493 | 1/1986 | Ikeda et al. | 346/140 R |
| 4,611,219 | 9/1986 | Sugitani | 346/140 |
| 4,635,077 | 1/1987 | Itoh | 346/140 |
| 4,638,337 | 1/1987 | Torpey et al. | 346/140 R |
| 4,774,530 | 9/1988 | Hawkins | 346/140 R |
| 4,786,357 | 11/1988 | Campanelli et al. | 156/633 |

*Primary Examiner*—Joseph W. Hartary

*Attorney, Agent, or Firm*—Robert A. Chittum

[57] ABSTRACT

A thermal ink jet printhead having an array of coplanar nozzles in a nozzle face that are entirely surrounded by an insulative polymeric material is disclosed, together with a method of fabrication thereof. The ink channels, nozzles, and reservoir are produced by sequentially depositing and patterning two layers of thick film material, such as Vacrel ®, on one substrate containing an array of heating elements and addressing electrodes, so that the heating elements are placed in a pit in the first thick film layer and the channels and reservoir recesses are produced in the overlaying second thick film layer. A second substrate having a third layer of the same thick layer and having a hole processed therethrough to serve as an ink inlet is aligned and bonded to the first substrate to form the printhead, with the second and third film layers bonded together in order to produce the nozzle which are surrounded by the thick film material.

8 Claims, 4 Drawing Sheets 4
13
30
32
45
44
48
42
22
43
47
40
28
27
49
41
25
26
20
46
51
28
12
19
4

FIG. 3
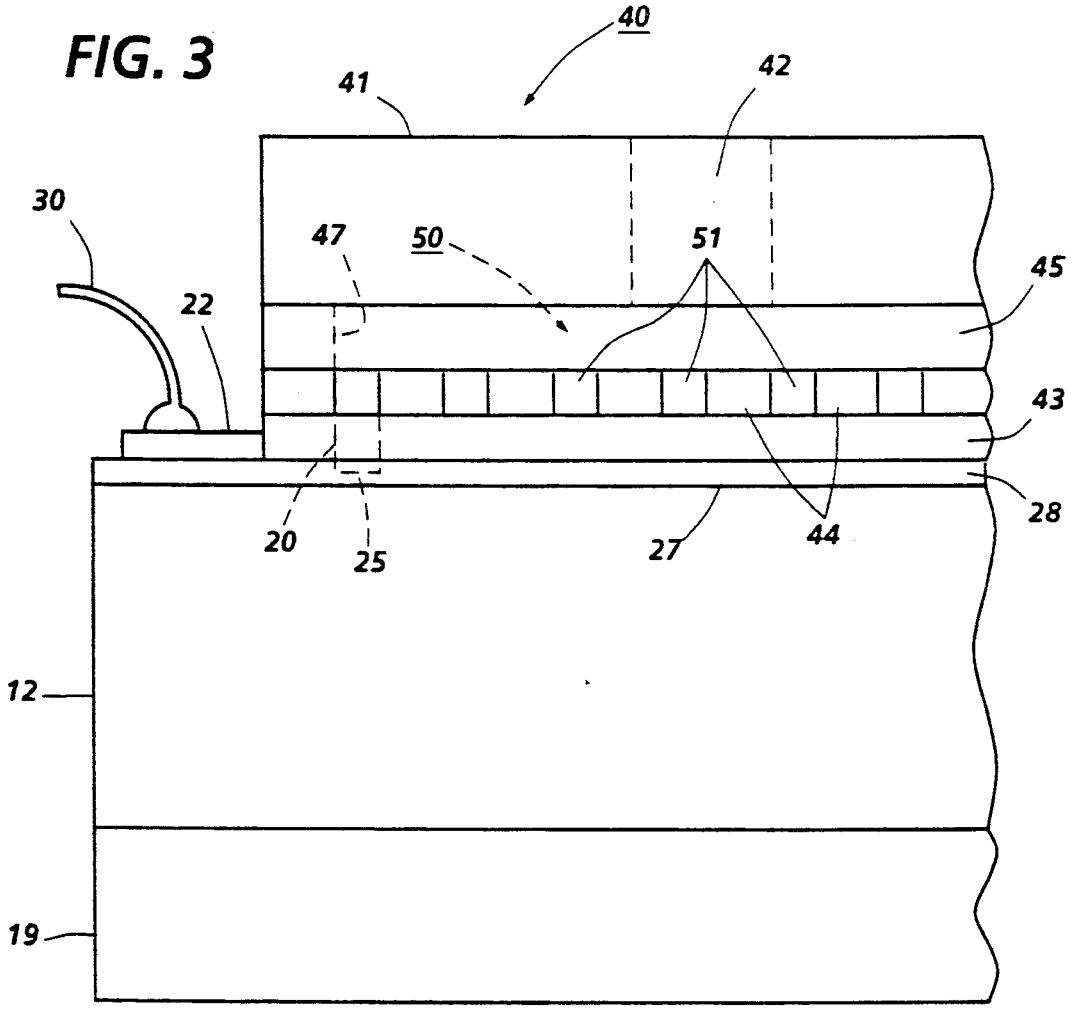
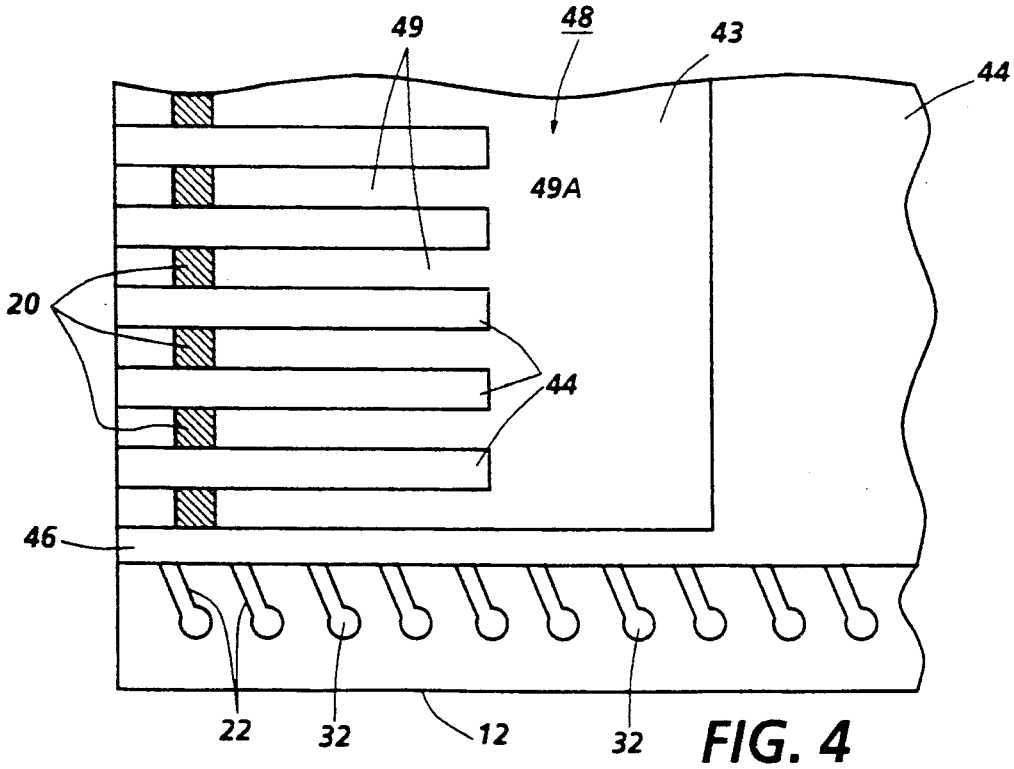
FIG. 4

INK JET PRINTHEAD

BACKGROUND OF THE INVENTION

This invention relates to ink jet printing devices and more particularly to a thermal ink jet printhead having an array of coplanar nozzles in a nozzle face that are entirely surrounded by an insulative polymeric material, together with a method of fabrication thereof.

Thermal ink jet printing is a type of drop-on-demand ink jet systems wherein an ink jet printhead expels ink droplets on demand by the selective application of a current pulse to a thermal energy generator, usually a resistor, located in capillary-filled parallel ink channels a predetermined distance upstream from the channel nozzles or orifices. The channels ends opposite the nozzles are in communication with an ink reservoir to which an external ink supply is connected. The current pulses momentarily vaporize the ink and form bubbles on demand. Each temporary bubble expels an ink droplet and propels it towards a recording medium. The printing system may be incorporated in either a carriage-type printer or pagewidth type printer. A carriage-type printer generally has a relatively small printhead containing the ink channels and nozzles. The printhead is usually sealingly attached to a disposable ink supply cartridge in a combined printhead and cartridge assembly which is reciprocated to print one swath of information at a time on a stationarily held recording medium, such as paper. After the swath is printed, the paper is stepped a distance equal to the height of the printed swath so that the next printed swath will be contiguous therewith. The procedure is repeated until the entire page is printed. In contrast, the pagewidth printer has a stationary printhead having a length equal to or greater than the width of the paper. The paper is continually moved past the printhead in a direction normal to the printhead length and at a constant speed during the printing process.

U.S. Pat. No. Re. 32,572 to Hawkins et al discloses a thermal ink jet printhead and method of fabrication. In this case, a plurality of printheads may be concurrently fabricated by forming a plurality of sets of heating elements with their individual addressing electrodes on one substrate, generally a silicon wafer, and etching corresponding sets of channel grooves with a common recess for each set of grooves in another silicon wafer. The wafer and substrate are aligned and bonded together so that each channel has a heating element. The individual printheads are obtained by milling away the unwanted silicon material to expose the addressing electrode terminals and then dicing the substrate to form separate printheads.

U.S. Pat. No. 4,638,337 to Torpey et al discloses an improved printhead of the type disclosed in the patent to Hawkins et al wherein the bubble generating resistors are located in recesses to prevent lateral movement of the bubbles through the nozzles and thus preventing sudden release of vaporized ink to the atmosphere that would result in ingestion of air.

U.S. Pat. No. 4,567,493 to Ikeda et al discloses a liquid jet recording head, including a plurality of protection layers, one of which has a region that directly contacts liquid. A principle function of the protection layer is to prevent penetration by the liquid and therefore prevent a failure mode for the bubble generating resistors and their addressing electrodes. It further discloses a liquid jet recording head wherein a liquid flow path is formed in the recording head by laminating a photosensitive resin dry film onto a base. The resin is photopatterned to form the liquid flow path and a liquid reservoir. A glass substrate is then adhesively bonded to the base to form the recording head.

U.S. Pat. No. 4,786,357 to Campanelli et al discloses the use of a patterned thick film insulative layer between mated and bonded substrates. One substrate has a plurality of heating element arrays and addressing electrodes formed on the surface thereof and the other being a silicon wafer having a plurality of etched reservoirs with each reservoir having a set of ink channels. The patterned thick film layer provides a clearance space above each set of contact pads of the addressing electrodes to enable the removal of the unwanted silicon material by dicing without the need for etched recesses therein. The individual printheads are produced subsequently by dicing the substrate having the heating element arrays.

U.S. Pat. No. 4,774,530 to Hawkins discloses the use of an etched thick film insulative layer to provide the flow path between the ink channels and the reservoir, thereby eliminating the fabrication steps required to open the channel groove closed ends to the manifold recess so that the printhead fabrication process is simplified.

A major problem with the existing ink jet printing devices is directionality of the ejected ink droplets. Any ridge or chip at the nozzle, any dried ink around the nozzle, or any different materials surrounding the nozzles which vary in wettability will have an effect on the droplet directionality. This invention solves the directionality problem by providing a nozzle that is entirely surrounded by the same material which provides a uniformly wettable surface and by greatly reducing the geometric effects such as ink formation or ridges or chips in the vicinity of the nozzle.

SUMMARY OF THE INVENTION

It is an object of the present invention to provide a printhead having nozzles in a printhead face or nozzle face that are entirely surrounded by the same material to present a more uniformly wettable surface with improved droplet directionality.

It is another object of the invention to use several layers of a thick film polymeric material such as Vacrel® to form the heating element pits, ink channels, and ink manifold which eliminates edge ridge and chip problems generally associated with two component ink jet printheads.

In the present invention, a printhead having ink channels, nozzles, and manifold are produced by sequentially depositing and patterning two layers of a thick film material such as Vacrel® on one substrate containing an array of heating elements and addressing electrodes, so that the heating elements are placed in a pit in the first thick film layer and the channels and reservoir recesses are produced in the overlaying second thick film layer. A second substrate, having a third layer of the same thick film material and having a hole processed therethrough to serve as an ink inlet, is aligned and bonded to the first substrate to form the printhead so that the second and third thick film layers are mated and bonded together to produce the nozzles which are surrounded by the thick film material. The thermal in jet printhead thus has an array of coplanar nozzles in a nozzle face that are entirely surrounded by the same insulative polymeric material.

A more complete understanding of the present invention can be obtained by considering the following detailed description in conjunction with accompanying drawings, wherein like index numerals indicate like parts.

BRIEF DESCRIPTION OF THE DRAWINGS

FIG. 3 is a partially shown front view of the printhead in FIG. 2.

FIG. 4 is a partially shown plan view of a printhead in FIG. 2 as viewed along view line A—A in FIG. 2.

BRIEF DESCRIPTION OF THE PREFERRED EMBODIMENT

Figure 1:
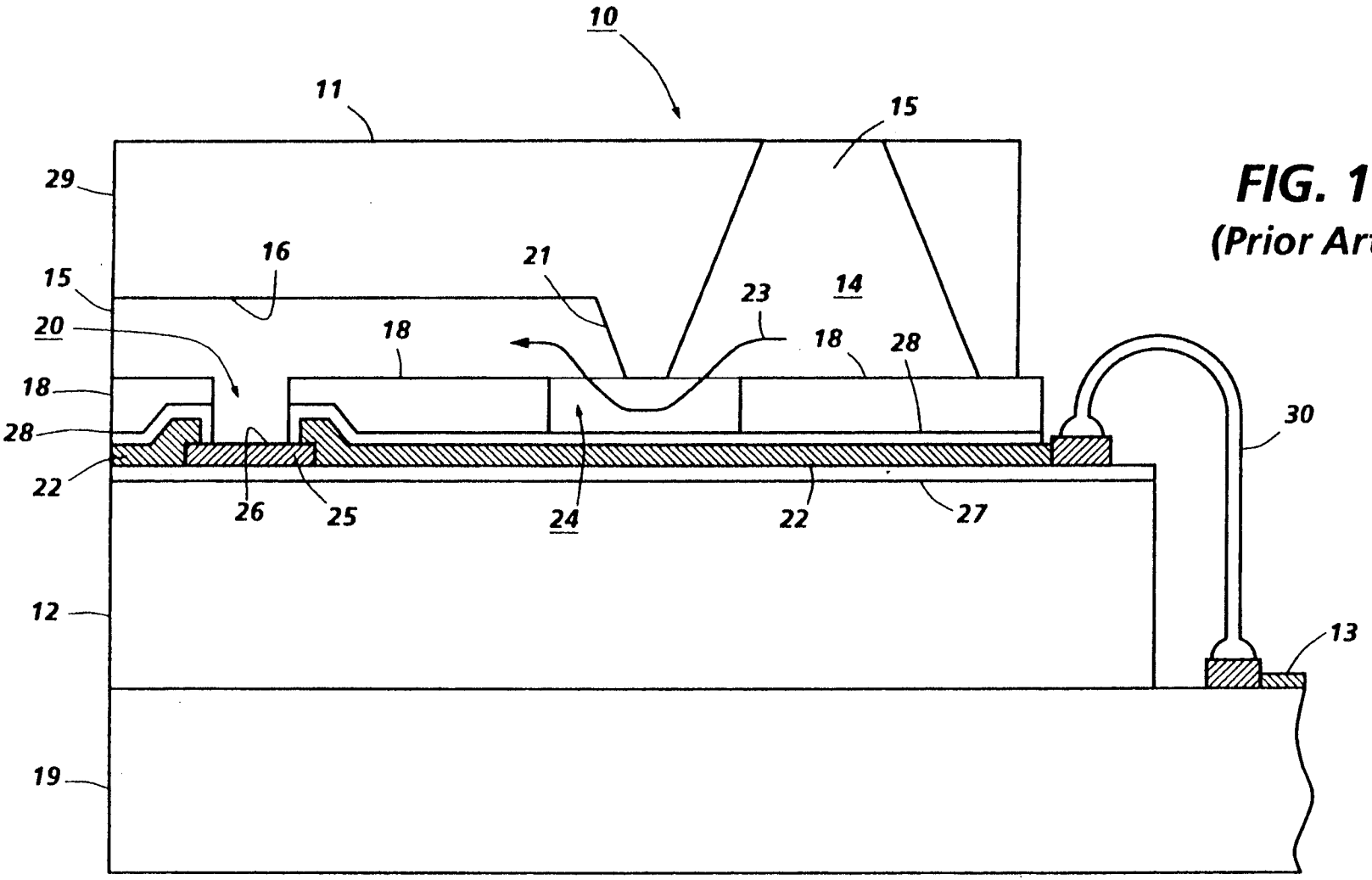
FIG. 1 (Prior Art)
FIG. 1 is an enlarged cross-sectional view of an ink jet printhead showing the electrode passivation and ink flow path between the manifold and the ink channels in a manner that is well known in the art.

A representative prior art thermal ink jet printhead is shown in FIG. 1 in a cross-sectional view along one of the ink channels. This prior art printhead 10 comprises an anisotropically etched channel plate 11 aligned and bonded to heater plate 12 and the printhead is fixedly attached to a daughter board 19 having electrodes 13 thereon which connect to a drive circuit and power supply (not shown). The channel plate 11 has a through etched reservoir 14 with its open bottom serving as inlet 15 and a plurality of channels 16 anisotropically etched therein. One end of the channels 16 open through nozzle face 29 and have a closed ends 21 perpendicularly adjacent and equidistant from the reservoir. The open ends of the channels serve as nozzles 17. The heater plate has an array of heating elements 25 and addressing electrodes 22 formed on the surface of the heater plate 12 which confronts the channel plate. The heating elements and electrodes are formed on an insulative layer 27 and are passivated by an insulative layer 28. A protective layer, such as tantalum, is deposited over the heating elements. A thick film insulative layer, such as Vacrel ®, Riston ® or polyimide is interposed between the heater plate and the channel plate. The thick film insulative layer is patterned to expose the heating elements, addressing electrode terminals, and to form a recess 24 in a location to enable the ink to flow from the reservoir 14 to the channels 16 around the closed end of the channels 21 as shown by arrow 23. The addressing electrodes of the printhead is connected to the daughter board electrodes 13 by wire bonds 30 which are subsequently passivated (not shown). The anisotropically etched channels 16 have a triangular cross-sectional area and the materials surrounding the nozzle at the nozzle face 29 is silicon on two sides of the triangular shaped nozzle and thick film layer material layer on the third. The channels are formed in a single crystal (100) silicon wafer by orientation dependent etching and, therefore, must follow very strict design rules which prevent the use of any etch mask pattern except rectangular shaped vias which result in triangular cross-sectional areas.

Figure 2:
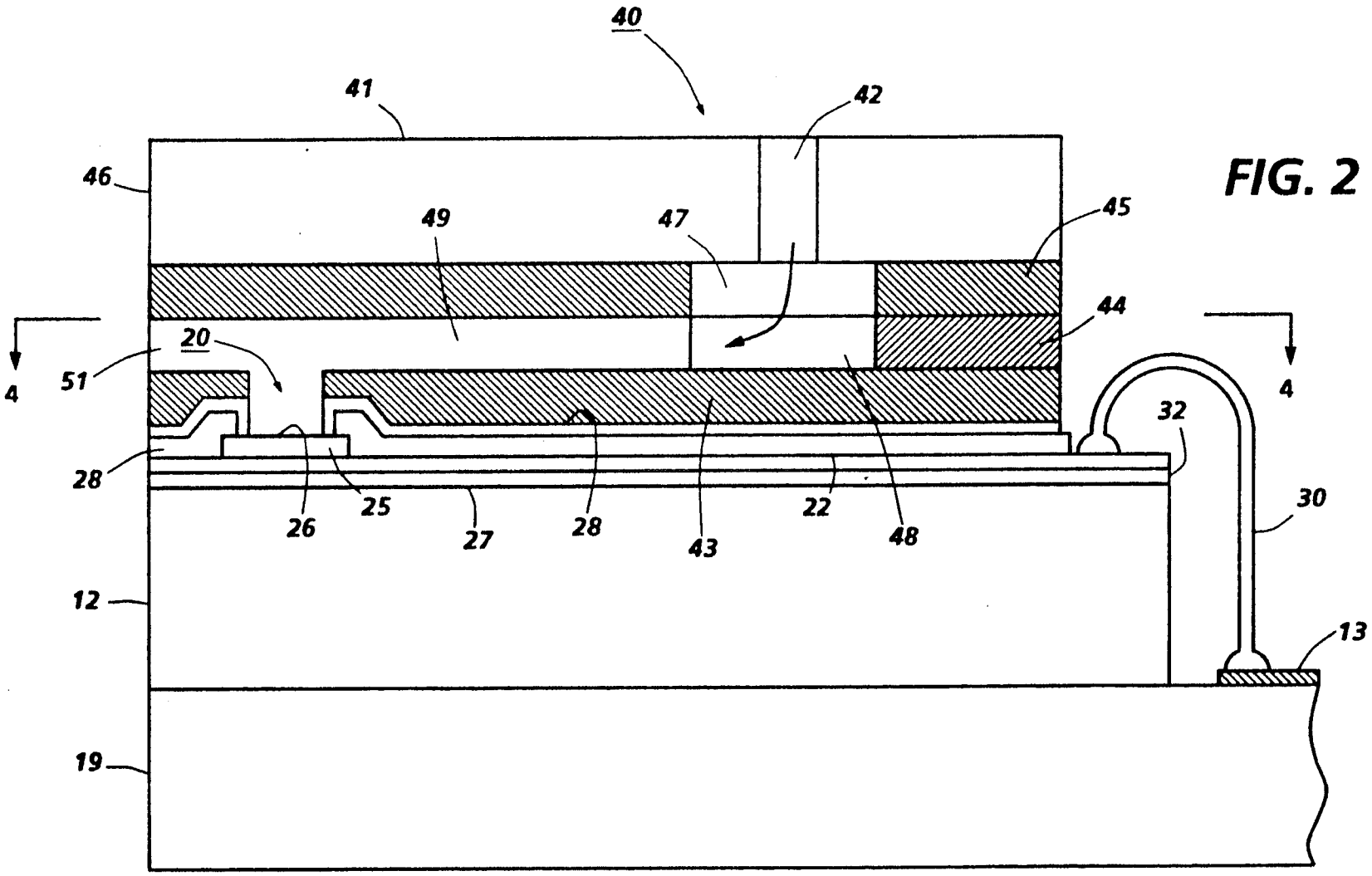
FIG. 2 is an enlarged cross-sectional view of the printhead of the present invention showing the ink inlet, manifold, channels, and nozzles.

In FIG. 2, a cross-sectional view of the printhead 40 of the present invention is shown as viewed through one channel and reservoir 50. As is disclosed in U.S. Pat. Nos. 4,638,337; 4,774,530; and Re. 32,572, incorporated herein by reference, a plurality of sets of bubble generating heating elements 25 and their addressing electrodes 22 are patterned on the polished surface of a double side polished (100) silicon wafer. Other insulative substrates, such as glass, quartz, or ceramic material may be used. Prior to patterning the multiple sets of printhead electrodes and the resistive material that serves as the heating elements, the surfaces of the wafer are coated with an underglaze layer 27, such as silicon dioxide, having a thickness of about 2 micrometers. The resistive material may be a doped polycrystalline silicon which may be deposited by chemical vapor deposition (CVD) or any other well known resistive material such as zirconium boride ($ZrB_2$). The addressing electrodes are typically aluminum leads deposited on the underglaze and over the edges of the heating elements. The addressing electrode terminals 32 are positioned at predetermined locations to allow later clearance for wire bonds 30 to the electrodes 13 of the daughter board 19, after the printhead is attached thereto. The addressing electrodes 22 are deposited to a thickness of 0.5 to 3 micrometers, with the preferred thickness being 1.5 micrometers.

In the preferred embodiment, polysilicon heating elements are used and a silicon dioxide thermal oxide layer (not shown) is grown from the polysilicon in high temperature steam. The thermal oxide layer is typically grown to a thickness of 0.5 to 1 micrometer to protect and insulate the heating elements from the conductive ink. The thermal oxide is patterned at the edges of the polysilicon heating elements and the active region for attachment of the addressing electrodes which are then deposited and patterned. If a resistive material such as zirconium boride is used for the heating elements, then other suitable well known insulative materials may be used for the protective layer thereover. Before electrode passivation, a tantalum (Ta) layer 26 may be optionally deposited to a thickness of about 1 micrometer on the heating element protective layer for added protection thereof against the cavitational forces generated by the collapsing ink vapor bubbles during printhead operation. The tantalum layer is etched off all but the protective layer directly over the heating elements using, for example, $CF_4/O_2$ plasma etching. For electrode passivation, a two micrometer thick phosphorous doped CVD silicon dioxide film 28 is deposited over the entire wafer surface, including the plurality of sets of heating elements and addressing electrodes. The passivation film provides an ion barrier which will protect the exposed electrodes from the ink. An effective ion barrier layer is achieved when its thickness is between 1,000 angstrom and 10 micrometers, with the preferred thickness being 1 micrometers. The passivation film or layer 28 is etched off of the terminal ends of the addressing electrodes and over the heating elements for wire bonding later with the daughter board electrodes. This etching of the silicon dioxide film may be by either the wet or dry etching method. Alternatively, the electrode passivation may be accomplished by plasma deposited silicon nitrite ($Si_3N_4$).

Next, a first thick dry film type insulative layer 43, such as, preferably Vacrel ® is formed on the passivation layer having a thickness of between 10 and 100 micrometers and preferably in the range of 25 to 50 micrometers. The insulative layer 43 is photolithographically processe to enable etching and removal of those portions of the layer over each heating element forming recesses or pits 20, and over each electrode terminal 32.

A thin layer of an epoxy adhesive (not shown) is optionally applied to the passivation layer 28 to facilitate adhesion of the Vacrel ® layer 43 to the passivation layer. A second thick film or Vacrel ® layer 44, which is identical to the first layer, is laminated to the first Vacrel ® layer, prior to curing the first layer containing the pits 20, and likewise photoprocessed to form a plurality of sets of recesses 49 to serve subsequently as sets of ink channels. Each of the elongated recesses 49 in each set of recesses are substantially perpendicular to and open into an elongated trench 48 which will subsequently serve as at least part of the printhead reservoir 50. The ends of the recesses 49 extend a predetermined distance from the reservoir trench or recess 48 and include in the distal portion thereof the heating elements 25 in pits 20. The distal ends of the elongated channel recesses 49 may terminate at precisely the desired distance beyond the heating elements or a distance beyond so that the separation step that produces the plurality of individual printheads also produces the nozzle face 46 with the nozzles 51 therein. A plan view of the patterned second Vacrel ® layer 44 is shown in FIG. 4, which is a partial views as viewed along line A—A of FIG. 2. Though the view is taken from a single printhead, it will be appreciated that this plan view also represents a plan view of a portion of the silicon wafer containing many reservoir recesses 48, each having a set of elongated recesses 49 perpendicularly extending therefrom, with the underlying patterned Vacrel ® layer 43 removed from the heating elements 25 to form the pits 20 and removed from the terminal ends or contact pads 32 of the addressing electrodes 22.

A substrate 41 of glass, quartz, or ceramic material, having the same circumferential dimensions as the silicon wafer containing the plurality of heater plates 12, is processed to form a plurality of inlet through holes 42, one for each reservoir recess 48 on the silicon wafter. A third Vacrel ® layer 45 is laminated to one surface of the substrate 41, preferably glass, and patterned to open the inlet holes 42, and form recesses 47 therein which are equal in size to the reservoir recesses 48. Optionally, the surface of the substrate 41 which is to receive the Vacrel ® layer 45 may be first coated with a thin layer of epoxy adhesive (not shown) to enhance adhesion of the Vacrel ® layer thereto.

The surface of the substrate 41 with the third layer 45 of Vacrel ® is aligned and mated with the second Vacrel ® layer 44 on the silicon wafer, so that the recesses 47 and 48 are aligned to form the reservoirs 50 and then the substrate and wafer are blanket exposed to UV light for 10 minutes, placed in an oven at a temperature of 150° C. and cured for 60–75 minutes, followed by a 20 minute UV exposure. After the Vacrel ® layers are cured, the plurality of individual printheads 40 are obtained by a dicing operation as disclosed in the above patents incorporated herein by reference.

A partially shown front view of a printhead 40 is depicted in FIG. 3 with the ink inlet 42, reservoir 50, and heating element pits 20 shown in dashed lines. The nozzle face 46 is shown coplanar with the surface of the sheet containing FIG. 3, with nozzles 51 therein, so that the ink droplets (not shown) would be ejected toward the viewer in a direction perpendicular to the sheet. This view of the printhead shows that the nozzles are entirely surrounded by the thick film layer, which in the preferred embodiment, is Vacrel ®. This material which surrounds and defines the nozzles provides a uniform wettable surface and improves droplet directionality.

Figure 4A:
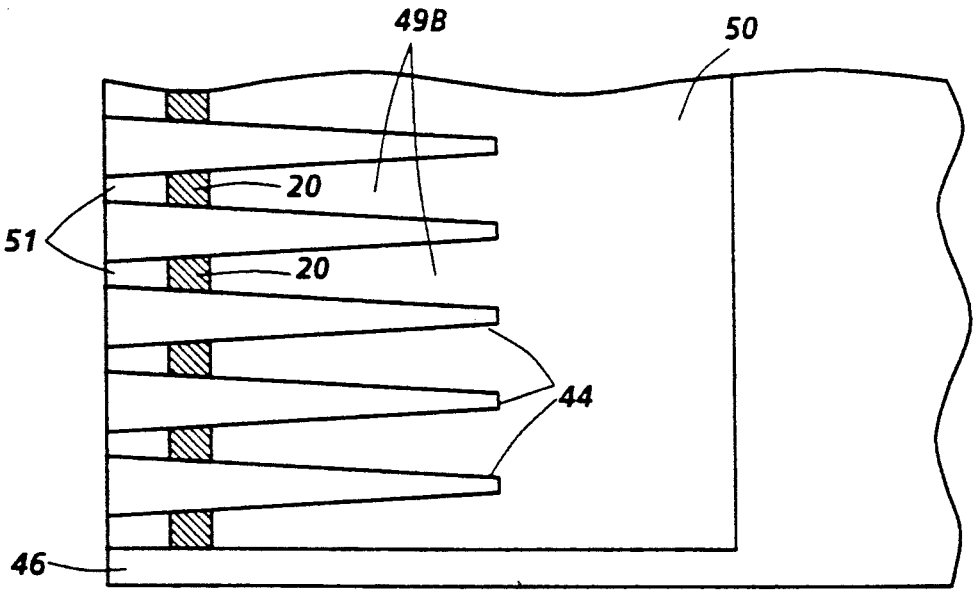
FIGS. 4A and 4B are views similar to FIG. 4, but showing alternate embodiments of the invention.
Figure 4B:
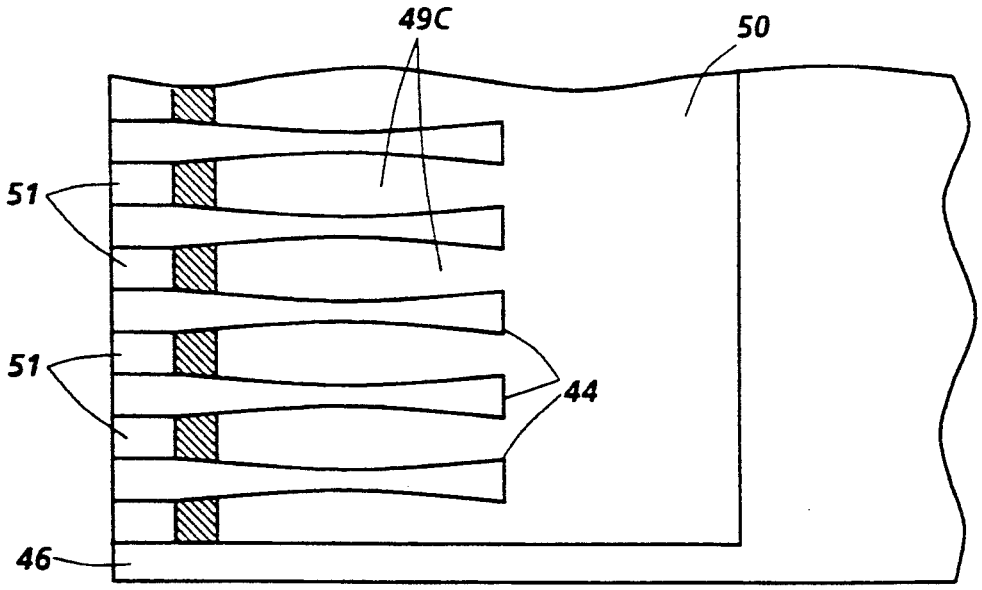

Though the elongated recesses 49 shown in FIG. 4 have parallel walls **49*a* with a uniform rectangular cross-sectional ink flow area, the parallel walls could vary in distance therebetween as shown in FIGS. 4A and 4B to provide ink channels 49*b* and 49*c*, respectively. In FIG. 4A, the channels 49*b* have a uniformly narrowing ink channel which tapers from the interface at the reservoir 50 to the nozzles 51, while in FIG. 4B, the channels 49*c* vary in cross-sectional flow area, such as, for example, narrow at the interface with the reservoir 50, enlarge to enhance refill near the mid distance of the channel from the manifold, and narrow again at the nozzles 51 in the nozzle face 46. Thus, the channel pattern in the second Vacrel ® layer 44** enables a variety of channel shapes to improve printhead performance.

Many modifications and variations are apparent from the foregoing description of the invention and all such modifications and variations are intended to be within the scope of the present invention.

I claim:

1. An ink jet printhead comprising:

a lower rigid substrate having formed on one surface thereof an array of heating elements and associated addressing electrodes with contact pads for electrical connection thereto, the addressing electrodes enabling the selective addressing of individual heating elements with a current pulse representing digitized data signals;

a passivation layer being deposited over the lower substrate surface and the heating elements and addressing electrodes formed thereon, the passivation layer being removed from the heating elements and contact pads;

a first thick film layer being deposited on the lower substrate surface and passivation layer theron and being patterned to remove the first thick film layer over the heating elements and contact pads, so that the removed first thick film layer over the heating elements places them in a pit;

a second thick film layer being deposited over the lower substrate surface and first thick film layer and patterned to form a plurality of parallel channels perpendicularly connected to a common reservoir recess at one end, the other channel ends being open and each containing a heating element in its respective pit a predetermined distance upstream from the channel open end;

an upper rigid substrate having at least one through hole and having a third thick film layer deposited on one surface thereof which is patterned to form a recess equal in size to the common reservoir recess in said second thick film layer and to clear the at least one through hole; and the third thick film layer on the upper substrate being aligned, mated, and bonded to the second thick film layer on the lower substrate to form the printhead, the mating of the substrates, spaced apart by the patterned first, second, and third thick film layers, providing a plurality of nozzles produced by the open channel ends in said second thick film layer, the nozzles being placed into communication with a common reservoir formed by the combined recesses in the second and third thick film layers, said nozzles thereby being entirely surrounded by the thick film layers.

2. The printhead of claim 1, wherein the thick film layers are all Vacrel®.

3. The printhead of claim 2, wherein the lower substrate is silicon and the upper substrate is glass.

4. The printhead of claim 3, wherein the channels have varying cross-sectional flow paths therethrough.

5. A method for fabricating a plurality of ink jet printheads having an array of ink droplet emitting nozzles in a nozzle face formed from multiple layers of the same material so that said nozzles are surrounded by a single material, the method comprising the steps of:

(a) forming a plurality of sets of linear arrays of resistive material on a first surface of a first rigid substrate for use as sets of heating elements;

(b) forming an insulative layer over each heating element;

(c) forming a plurality of sets of addressing electrodes on the first substrate first surface for enabling selective application of electrical pulses to each heating element, at least some of the electrodes terminating with a contact pad for connection to an external source of electrical pulses;

(d) passivating the addressing electrodes with a passivation layer, the heating elements and electrode contact pads being left exposed;

(e) depositing a first layer of thick film insulative material having a thickness range of 5 to 100 micrometers over the passivation layer, heating elements, and contact pads on the first substrate first surface;

(f) patterning the first layer of thick film insulative material to provide a separate recess over each heating element in each array and exposing all of the electrode contact pads;

(g) depositing a second layer of said thick film insulative material having the same thickness range over the first layer, separate recesse therein, and exposed contact pads;

(h) patterning the second layer of said thick film insulative material to form a plurality of sets of parallel elongated recesses, each elongated recess in each set containing one of the separate recesses in the first layer of the thick film insulative material, each set of elongated recesses perpendicularly connecting to a common recess at one end, the other distal end being a predetermined distance from the common recess so that the distal end portion contains the heating elements exposed by the separate recesses in the first layer;

(i) forming a plurality of holes in predetermined locations through a second rigid substrate;

(j) depositing a third layer of the thick film insulative material on a surface of the second substrate;

(k) patterning the third layer of thick film insulative material to form a plurality of recesses equal in size to the common recesses in said second layer of thick film material, the location of the third layer recesses opening the holes in the second substrate;

(l) aligning and bonding first and second substrates together with the third layer of thick film insulative material being brought into contact with the second layer of thick film insulative material, so that ink channels are formed by the elongated recesses, reservoirs are formed by the equally sized recesses in the second and third layers of thick film material, and the holes in the second substrate are in communication with the reservoirs and service as ink inlets;

(m) curing the layers of thick film insulative material sandwiched between the substrates; and (n) dicing the bonded substrates into a plurality of individual printheads, with one of the dicing cuts being through each of the ink channels and perpendicular thereto to open the distal ends of the channels and thereby forming the printhead nozzles in a printhead nozzle face, the dicing cut which forms the nozzle and nozzle face being at a location to place the heating elements in the separate recesses in the first layer of thick film insulative material a predetermined distance upstream from the nozzles, whereby the nozzle is entirely surrounded by the thick film insulative material, thus providing a uniformly wettable surface that improves ejected droplet directionality.

6. The method of claim 5, wherein the thick film insulative material is Vacrel®.

7. The method of claim 6, wherein the first substrate is silicon, and wherein the second substrate is glass.

8. The method of claim 7, wherein the method further comprises the step of:

(o) applying a relatively thin layer of adhesive to the passivation layer on the first substrate and to the surface of the second substrate, prior to depositing the respective layers of Vacrel® thereon.

* * * * *